US008631971B2

(12) United States Patent
Edwards

(10) Patent No.: US 8,631,971 B2
(45) Date of Patent: Jan. 21, 2014

(54) BAG IN BOX PACKAGING HAVING AN INSERTABLE TRAY

(75) Inventor: Simon P. Edwards, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 13/355,095

(22) Filed: Jan. 20, 2012

(65) Prior Publication Data

US 2012/0205396 A1 Aug. 16, 2012

Related U.S. Application Data

(63) Continuation of application No. PCT/US2010/040666, filed on Jun. 30, 2010.

(60) Provisional application No. 61/271,397, filed on Jul. 21, 2009.

(51) Int. Cl.
*B65D 35/56* (2006.01)
*B67D 7/06* (2010.01)

(52) U.S. Cl.
USPC ..... 222/105; 222/183

(58) Field of Classification Search
USPC ..... 222/105, 107, 185.1, 528, 532, 183, 222/181.1, 181.2, 181.3; 229/117.3, 229/117.31, 117.34, 117.27; 383/906
See application file for complete search history.

(56) References Cited

U.S. PATENT DOCUMENTS

| | | | | |
|---|---|---|---|---|
| 3,253,764 | A * | 5/1966 | Goetschius et al. | 229/117.3 |
| 4,174,051 | A * | 11/1979 | Edwards et al. | 222/105 |
| 6,644,367 | B1 * | 11/2003 | Savage et al. | 141/383 |
| 7,246,721 | B2 * | 7/2007 | Pritchard | 222/105 |
| 2009/0159594 | A1 * | 6/2009 | Nielsen et al. | 220/8 |

* cited by examiner

*Primary Examiner* — Kevin P Shaver
*Assistant Examiner* — Stephanie E Williams
(74) *Attorney, Agent, or Firm* — The Watson I.P. Group, PLC; Jovan N. Jovanovic; Vladan M. Vasiljevic

(57) ABSTRACT

A bag in box packaging comprising an outer box, an inner bag and a tray member. The outer box includes an opening at the lower end of the front wall and onto the bottom wall. A pair of opposing slits extend along the lower edge on opposing sides of the opening thereat. The spout and/or the tap extend through an opening in the base so that the tap and the inner bag are on opposite sides of the base. A pair of opposing channels are defined between the respective flange and the dispensing wall interfacing surface of the tray. The tray member can be slid into position by extending the front wall between the respective flange and the dispensing wall interfacing surface and into the respective opposing channels defined thereby, to, in turn, secure the tray to the outer box.

5 Claims, 5 Drawing Sheets

BAG IN BOX PACKAGING HAVING AN INSERTABLE TRAY

CROSS-REFERENCE TO RELATED APPLICATION

This application is a continuation of PCT/US2010/040666 filed Jun. 30, 2010, entitled "Bag In Box Packaging Having an Insertable Tray" which claims priority from U.S. Prov. Pat. App. Ser. No. 61/271,397 filed Jul. 21, 2009, entitled "Bag In Box Packaging Having an Insertable Tray," the entire specification of each of the foregoing is incorporated herein by reference.

BACKGROUND OF THE DISCLOSURE

1. Field of the Disclosure

The disclosure relates in general to bag in box packaging, and more particularly, to a bag in box packaging that has a locating panel for a tap.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE INVENTION

The invention is directed to a bag in box packaging comprising an outer box, an inner bag and a tray member. The outer box includes a bottom wall and a front wall with an opening toward the lower end thereof extending beyond a lower edge of the front wall and onto the bottom wall. A pair of opposing slits extend along the lower edge on opposing sides of the opening thereat. The inner bag has a spout and a tap. The tray member has a base with an opening extending therethrough. At least one of the spout and the tap extend through the opening so that the tap and the inner bag are on opposite sides of the base. The tray member further includes an upstanding perimeter wall extending from the base, a dispensing wall interfacing surface at the end of the upstanding perimeter wall spaced apart from the base, and a pair of opposing flanges spaced apart from the dispensing wall interfacing surface. A pair of opposing channels are defined between the respective flange and the dispensing wall interfacing surface. The tray member can be slid into position by extending the front wall between the respective flange and the dispensing wall interfacing surface and into the respective opposing channels defined thereby, to, in turn, secure the tray to the outer box.

In a preferred embodiment, an upstanding perimeter wall extends between the base and the dispensing wall interface surface. Upon positioning of the tray member into position, an inner surface of the bottom wall is positioned to overlie the upstanding perimeter wall. This, in turn, secures the tray member and substantially precludes slidable movement of the front wall within the opposing channels.

In another preferred embodiment, an adhesive can be applied to one of the tray and the outer box to substantially preclude inadvertent slidable movement of the front wall within the opposing channels.

In another preferred embodiment, the upstanding perimeter wall has a height, and the tap has a height which is substantially equal to or less than the height of the upstanding perimeter. As a result, the tap does not extend out of the tray and the tray protects the tap from damage.

In another preferred embodiment, the tray member comprises a molded polymer member.

In another aspect of the invention, the invention comprises a method of assembling a bag in box packaging comprising the steps of: providing an outer box having a bottom wall and a front wall with an opening toward the lower end thereof extending to a lower edge of the front wall and an adjacent wall, a pair of opposing slits extending along the lower edge on opposing sides of the opening thereat; providing an inner bag having a spout with a tap; providing a tray member having an opening extending therethrough and an upstanding perimeter wall extending from the base, a dispensing wall interfacing surface at the end of the upstanding perimeter wall spaced apart from the base, and a pair of opposing flanges spaced apart from the dispensing wall interfacing surface so as to define a pair of opposing channels between the respective flange and the dispensing wall interfacing surface; coupling one of the inner bag, the spout and the tap with the opening extending through the tray member so that the tap is on one side of the base and the inner bag is on the other side of the base; filling the inner bag with a flowable material; inserting the inner bag into the outer box; and sliding the front wall into each of the opposing channels to secure the tray to the outer box.

In a preferred embodiment, the method further includes the step of sealing the bottom wall to at least one of another wall of the outer box and the tray after the step of sliding the front wall.

In another preferred embodiment, the method further includes the step of adhering the tray to the outer box upon the step of sliding.

BRIEF DESCRIPTION OF THE DRAWINGS

The disclosure will now be described with reference to the drawings wherein.

DETAILED DESCRIPTION OF THE DISCLOSURE

Figure 1:
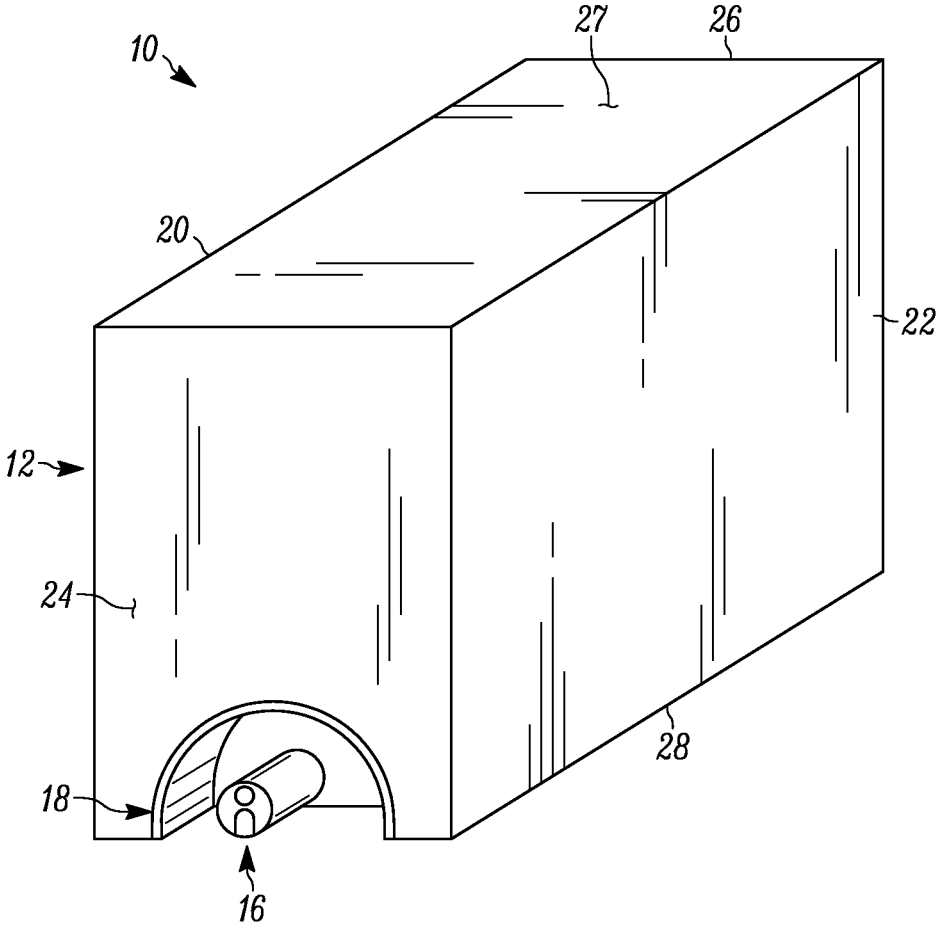
FIG. 1 of the drawings is a perspective view of a bag in box package made in accordance with the teachings of the present invention, showing in particular, the outer container in a dispensing orientation.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, bag in box packaging is shown generally at 10. The bag in box packaging can be utilized in association with any number of different flowable materials. Inasmuch as one feature of the invention is the location of a tap, one use of the bag in box packaging is its use in association with wine products and the like. It will be understood that the invention is not limited to its use in association with wine products, and such use is described only for purposes of being exemplary. In other embodiments, other fluids can be utilized in its stead.

Figure 5:
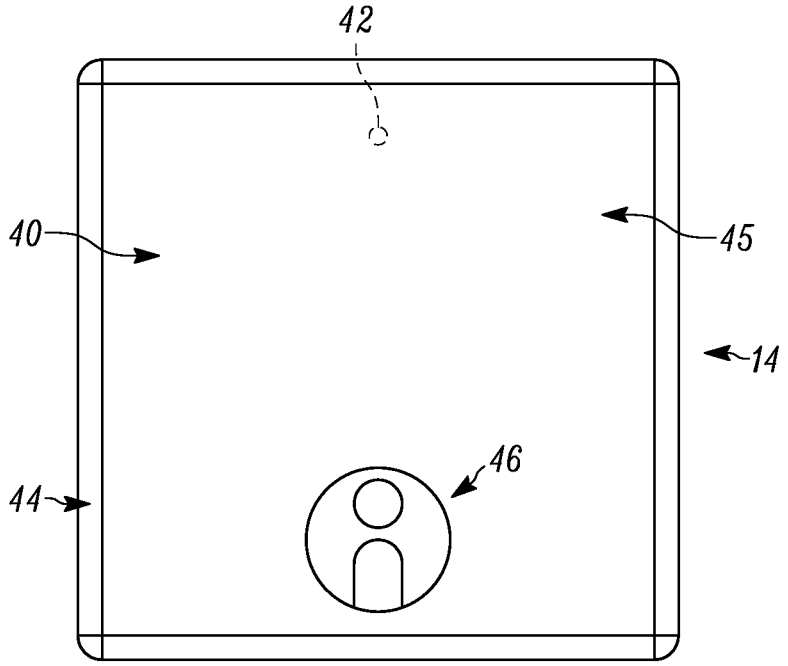
FIG. 5 of the drawings is a front elevational view of the inner bag which is inserted into the outer box of the present invention.

The bag in box packaging is shown in FIG. 1 as comprising outer box 12, inner bag 14 (FIG. 5), tap 16 and tray member 18. The outer box 12 comprises a generally rectangular cubic container (although variously shaped containers are contemplated for use). The outer box 12 includes first sidewall 20, second sidewall 22, front wall 24 (also referred to as the dispensing wall), back wall 26, top wall 27 and bottom wall 28. In the configurations shown, the first and second sidewalls have a larger surface area than the remaining walls. The front wall and the back wall comprise narrow, elongated wall structures. Again, a number of different shapes are contemplated, and the foregoing comprises a description of a preferred embodiment.

In the embodiment shown, the outer box 12 may comprise a corrugated paperboard material. In other embodiments, the outer box may comprise a single or multiply paperboard material. In still other embodiments, corrugated polymer board, or polymer board may be utilized. Indeed, the invention is not limited to any particular material from which the outer box 12 is formed.

Figure 4:
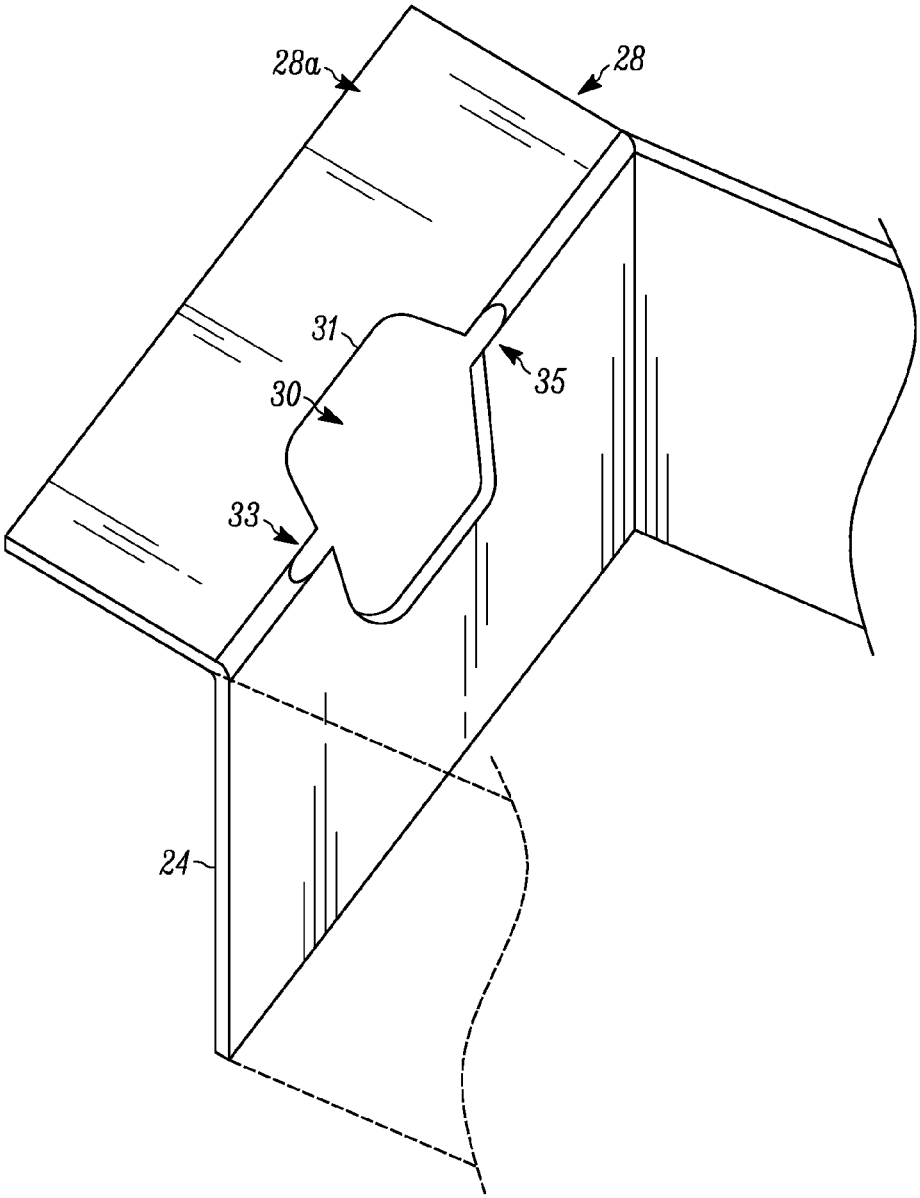
FIG. 4 of the drawings is a partial perspective view of a bag in box package made in accordance with the teaching of the present invention, showing in particular, the opening and slits of the outer box.

With reference to FIG. 4, the dispensing wall 24 and the bottom wall 28 collectively include opening 30 at the lower end thereof. The opening is defined by perimeter edge 31. The opening, as will be explained, is sized so as to receive a tray to which the spout and tap of the bag are coupled. A pair of opposing slits 33, 35 are positioned on either side of the opening 30 at the edge between the bottom wall 28 (and in particular bottom wall flap 28*a*) and the dispensing wall 24. These slits, as will be explained, assist in coupling the channel of the tray with the dispensing wall 24.

Figure 2:
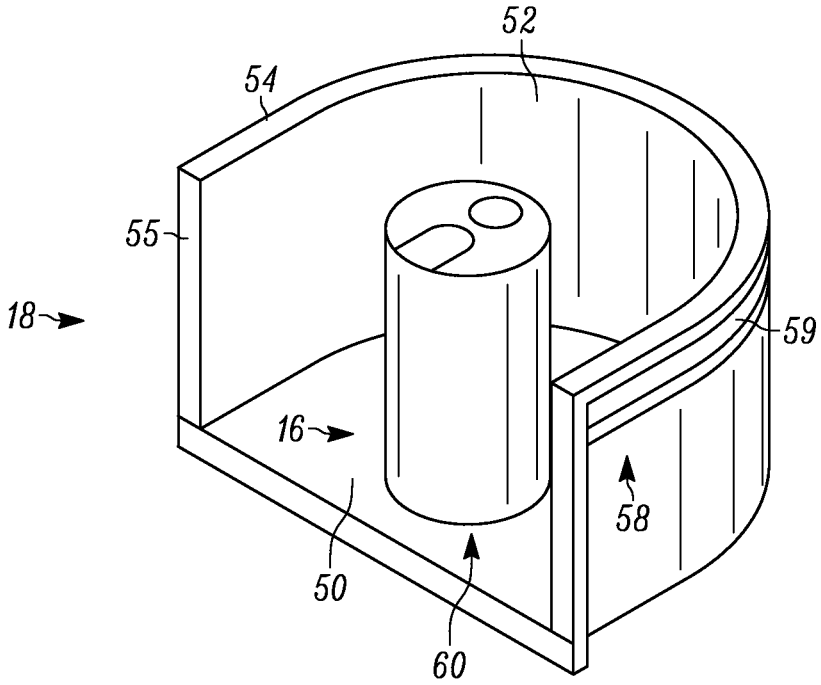
FIG. 2 of the drawings is a perspective view of a tray made in accordance with the teachings of the present invention.

The inner bag 14 is shown in FIG. 2 as comprising front panel 40, back panel 42, seals 44 and spout 46. The inner bag 14 is shown as comprising a conventional pillow-type container. In other embodiments, gusseted containers are likewise contemplated for use. The front panel 40 and the back panel 42 are generally coextensive and positioned in an overlying configuration. The two panels are joined together with seals, such as seals 44 which generally extend about the periphery of the two panels. The seals and the front and back panel cooperate to define cavity 45 which is substantially fluid-tight cavity. Spout 46 provides ingress and egress of fluid into and from within the cavity 45. The spout typically includes a flange that is welded to the inside or the outside of the front panel, and includes a plurality of flanges disposed along the length thereof. The inner bag is sized so as to fit within the outer box.

Tap 16 is coupled to the spout 46. The tap 16 may comprise any number of different types and styles of taps. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb. Of course, other taps are likewise contemplated. The foregoing patents are incorporated by reference herein in their entirety.

Figure 3A:
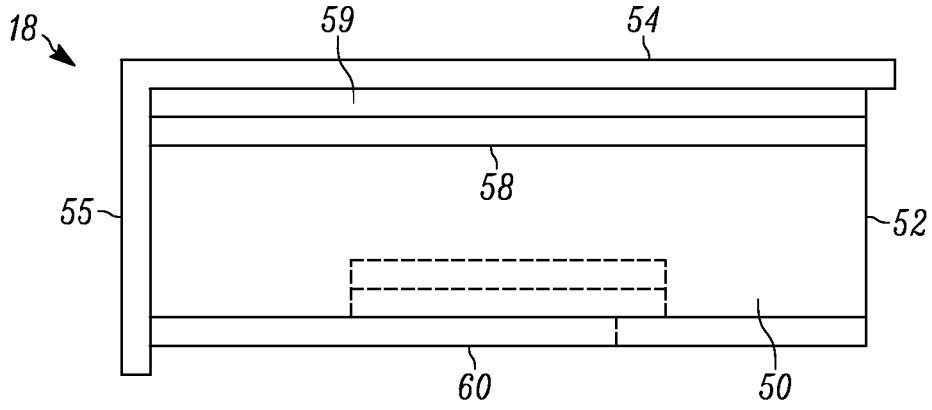
FIG. 3*a* of the drawings is a right side view of a tray made in accordance with the teachings of the present invention.
Figure 3B:
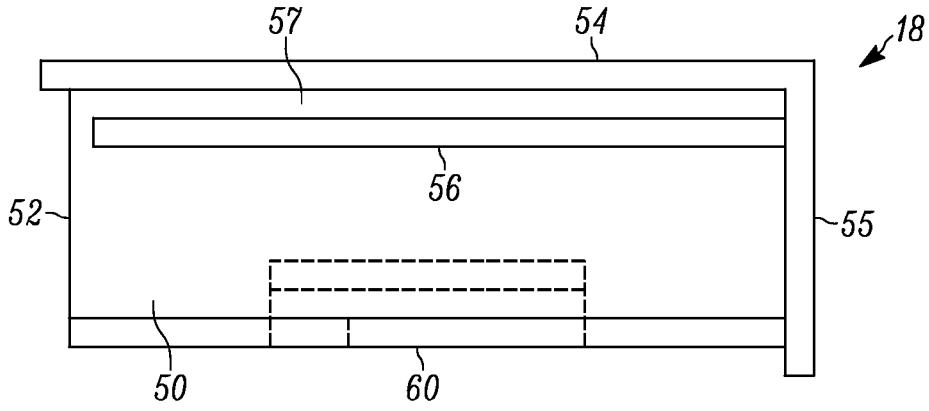
FIG. 3*b* of the drawings is a left side view of a tray made in accordance with the teachings of the present invention.

With reference to FIGS. 2, 3*a* and 3*b*, tray member 18 comprises base 50, upstanding perimeter wall 52, dispensing wall interfacing surface 54, back wall interfacing surface 55, first opposing flange 56 and second opposing flange 58. The base 50 includes an opening 60 through which the spout is extended. Typically, the spout is coupled to the opening 60 and substantially locked thereto. The upstanding perimeter wall 52 extends about the perimeter of the base 50 which corresponds to the portion of the opening 30 which is located on the dispensing wall. The dispensing wall interfacing surface 54 is substantially perpendicular to the upstanding perimeter wall 52 (and substantially parallel with the base 50). The dispensing wall interfacing surface 54 interfaces with the outside surface of the dispensing wall about the opening 30 which is on the dispensing wall. The back wall interfacing surface 55 interfaces with the inside surfaces of the bottom wall 28 to secure the tray member 18 thereto A first opposing flange 56 is positioned substantially parallel to and below the dispensing wall interfacing surface 54 on one side of the base 50. The first opposing flange 56 and the dispensing wall interfacing surface 54 together define a first channel 57. The width of the channel substantially corresponds to the thickness of the dispensing wall 24. Similarly, a second opposing flange 58 is positioned substantially parallel to and below the dispensing wall interfacing surface 54 on the other side of the base 50 (i.e., opposite the first opposing flange 56). The second opposing flange 58 and the dispensing wall interfacing surface 54 together define a second channel 59. The width of the second opposing channel substantially corresponds to the thickness of the dispensing wall 24.

In operation of the embodiment shown, the assembler provides a bag that can be empty, partially filled, completely filled, folded or in any other configuration. The bag is coupled to the tray member 18. In certain embodiments, the bag or the spout is mechanically fastened to the tray member. In other embodiments, the bag or spout is glued to the tray member. In either configuration, the two are mated together in a substantially non-releasable manner.

Once coupled, the box is assembled, with the bottom wall remaining in an unassembled configuration so as to provide ingress into the cavity of the box. With the flaps of the bottom wall being in an unassembled configuration, the bottom wall flap 28*a* can be opened further so as to expose the opposing slits 33, 35 which extend along the edge between the bottom wall flap and the dispensing wall on opposing sides of the opening.

The assembler then grasps the tray member 18 and directs the tray so that the dispensing wall 54 extends through the slits 33, 35 thereby capturing the dispensing wall in the opposing channels 57, 59 defined by the dispensing wall interfacing surface 54 and the opposing flanges 56, 58, respectively. The tray member 18 is then slid until the dispensing wall is fully within the opposing channels 57, 59 and until the slits are proximate the back wall interfacing surface 55.

In such an orientation, the tray 18 is fully slid into position and in its operative orientation. The bottom wall is then closed and sealed, sealing the outer box. To fully locate and retain the tray, it will be understood that the tray can be adhered to the dispensing wall 24 by inserting a bead of glue within the first and second channel. Similarly, the tray can be adhered to the bottom wall by applying a bed of glue to the outer surface of the back wall interfacing surface prior to closing the bottom flaps.

It will be understood that with such a configuration of the outer box (and, in particular the opening located proximate an edge, and slits cooperatively positioned with respect to the opening, simultaneous interfacing with the opposing surfaces of the dispensing wall about the opening can be provided. Thus, the tray can be coupled to the outer box with a bag that is in any one of a number of different configurations.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box packaging comprising:

an outer box having a bottom wall and a front wall with an opening toward the lower end thereof extending beyond a lower edge of the front wall and onto the bottom wall, and defining a perimeter, a pair of opposing slits extending along the lower edge on opposing sides of the opening thereat, with the opposing slits confined to the lower edge and defining the boundary between the front wall and the bottom wall, with the opening on either side of the slits being narrower than the opposing slits, such that the opposing slits extend outwardly beyond the perimeter of the opening on either side thereof;

an inner bag having a spout with a tap;

a tray member having a base substantially corresponding in shape to the portion of the outer perimeter of the opening of the outer box defined on the front wall, having an opening extending therethrough, at least one of the spout and tap extending through the opening so that the tap and the inner bag are on opposite sides of the base, the tray member further including an upstanding perimeter wall extending from the base, a dispensing wall interfacing surface at the end of the upstanding perimeter wall spaced apart from the base and corresponding to the portion of the perimeter of the opening of the outer box corresponding to the front wall, and a pair of opposing flanges spaced apart from the dispensing wall interfacing surface so as to define a pair of opposing channels between the respective flange and the dispensing wall interfacing surface, and having a back wall interfacing surface corresponding to the portion of the perimeter of the opening of the outer box corresponding to the bottom wall, wherein the tray member can be slid into position by extending the front wall between the respective flange and the dispensing wall interfacing surface and into the respective opposing channels defined thereby, to, in turn, secure the tray to the outer box, with the dispensing wall interface extending over a portion of the outer perimeter of the opening of the outer box corresponding to the front wall, and with a back wall interfacing surface following the contours of the portion of the perimeter of the opening of the outer box corresponding to the bottom wall.

2. The bag in box packaging of claim 1 wherein further comprising a upstanding perimeter wall extending between the base and the dispensing wall interface surface, whereupon positioning of the tray member into position, an inner surface of the bottom wall is positioned to overlie the upstanding perimeter wall, and, to, in turn secure the tray member and to substantially preclude slidable movement of the front wall within the opposing channels.

3. The bag in box packaging of claim 2 wherein an adhesive can be applied to one of the tray and the outer box to substantially preclude inadvertent slidable movement of the front wall within the opposing channels.

4. The bag in box packaging of claim 1 wherein the upstanding perimeter wall has a height, and wherein the tap has a height which is substantially equal to or less than the height of the upstanding perimeter.

5. The bag in box packaging of claim 1 wherein the tray member comprises a molded polymer member.

* * * * *